US009914227B2

(12) United States Patent
Greadington et al.

(10) Patent No.: US 9,914,227 B2
(45) Date of Patent: Mar. 13, 2018

(54) OPENER DEVICE

(71) Applicants: Barbara Greadington, Tallahassee, FL (US); Robert E Sharpton, Miami, FL (US)

(72) Inventors: Barbara Greadington, Tallahassee, FL (US); Robert E Sharpton, Miami, FL (US)

( * ) Notice: Subject to any disclaimer, the term of this patent is extended or adjusted under 35 U.S.C. 154(b) by 0 days.

(21) Appl. No.: 15/053,781

(22) Filed: Feb. 25, 2016

(65) Prior Publication Data

US 2016/0194187 A1 Jul. 7, 2016

Related U.S. Application Data

(63) Continuation-in-part of application No. 13/917,268, filed on Jun. 13, 2013.

(60) Provisional application No. 61/658,967, filed on Jun. 13, 2012.

(51) Int. Cl.

| | |
|---|---|
| ***B26B 17/00*** | (2006.01) |
| ***B67B 7/46*** | (2006.01) |
| ***B26D 3/12*** | (2006.01) |
| ***B65B 69/00*** | (2006.01) |
| ***B67B 7/18*** | (2006.01) |
| *B26F 1/36* | (2006.01) |

(52) U.S. Cl.

CPC ..... *B26B 17/00* (2013.01); *B26D 3/12* (2013.01); *B65B 69/0008* (2013.01); *B67B 7/18* (2013.01); *B67B 7/30* (2013.01); *B26F 2001/365* (2013.01)

(58) Field of Classification Search

CPC . B26B 13/28; B26B 17/00; B26F 1/36; B26F 2001/365; B65B 61/02; B65B 69/0008; B67B 7/18; B67B 7/30; B26D 3/12

USPC ..... 7/151, 156, 158; 30/DIG. 3, 1.5, 131, 30/186–190, 120.1–120.4, 363, 178, 253, 30/142, 175, 294; 81/3.4, 3.44, 3.07, 81/3.09, 3.56; D8/39–41, 98

See application file for complete search history.

(56) References Cited

U.S. PATENT DOCUMENTS

| | | | | |
|---|---|---|---|---|
| 271,104 A * | 1/1883 | Newton | B26F 1/36 | 30/363 |
| 764,336 A * | 7/1904 | Bernard | B26F 1/36 | 30/363 |
| 1,157,489 A * | 10/1915 | Yorke | B26B 13/22 | 30/DIG. 3 |
| 1,176,793 A * | 3/1916 | Tuttle | B21D 39/034 | 30/363 |
| 1,265,760 A * | 5/1918 | Edwards | B67B 7/24 | 30/450 |

(Continued)

FOREIGN PATENT DOCUMENTS

| | | | |
|---|---|---|---|
| CH | 226737 A * | 4/1943 | B26F 1/36 |
| FR | 877611 A * | 12/1942 | B26F 1/36 |

(Continued)

*Primary Examiner* — Jason Daniel Prone

(74) *Attorney, Agent, or Firm* — Adrienne C. Love

(57) ABSTRACT

The device has two arms connected together at a first end. At the second end of the first arm the device has a gripping member. At the second end of the second arm is a slitting member. The gripping member and slitting member meet together in order to puncture and tear open a snack bag. A gripping surface on the interior surface of each arm are able to grip the cap of a bottle or jar to assist in opening.

18 Claims, 16 Drawing Sheets

(56) References Cited

U.S. PATENT DOCUMENTS 1,377,055 A * 5/1921 Boisseau ..... B26F 1/14 30/363
1,464,807 A * 8/1923 Clark ..... A61C 13/12 30/363
1,650,084 A * 11/1927 Mason ..... B43M 7/007 30/DIG. 3
1,679,039 A * 7/1928 Kucera ..... B25B 7/20 30/363
1,928,120 A * 9/1933 Winton ..... B67B 7/30 30/363
D92,879 S * 7/1934 Canter ..... D8/388
2,027,785 A * 1/1936 Rauh ..... B67B 7/44 30/1.5
2,082,699 A * 6/1937 Keppinger ..... B67B 7/18 D8/39
2,254,738 A * 9/1941 Gamache ..... B26B 17/00 30/175
2,307,617 A * 1/1943 Braun ..... B26F 1/36 30/363
2,523,544 A * 9/1950 Stamp ..... B67B 7/44 30/1.5
2,599,968 A * 6/1952 Acard ..... B67B 7/44 30/1.5
2,679,098 A * 5/1954 Deicken ..... B43M 7/002 30/DIG. 3
2,691,909 A * 10/1954 Hopmann ..... B67B 7/44 D8/39
2,729,125 A * 1/1956 Krzanowski ..... B67B 7/30 30/1.5
2,815,572 A * 12/1957 Deicken ..... B43M 7/002 30/DIG. 3
2,825,133 A * 3/1958 Goldberg ..... A01G 3/00 30/253
2,897,591 A * 8/1959 Nastasi et al. ..... B23D 29/026 30/253
2,990,213 A * 6/1961 Kolacinski ..... A47J 43/283 7/151
3,015,160 A * 1/1962 Fogle ..... A01G 3/02 30/253
3,142,119 A * 7/1964 O'Brien ..... B43M 7/002 30/DIG. 3
3,276,119 A * 10/1966 Brucker ..... B26B 5/005 D8/98
3,372,482 A * 3/1968 Mercorelli ..... B26F 1/36 30/363
4,179,954 A * 12/1979 Whalen ..... B67B 7/18 81/3.44
4,291,464 A * 9/1981 Garrett ..... B26F 1/36 30/363
D276,786 S * 12/1984 Chen ..... D8/41
4,581,823 A * 4/1986 Gilman ..... B26B 27/00 30/314
4,658,456 A * 4/1987 Tsai ..... B25B 7/00 7/151
4,711,031 A * 12/1987 Annello ..... B26B 27/00 30/DIG. 3
4,815,210 A * 3/1989 Burrage ..... A61B 17/282 30/176
4,817,287 A * 4/1989 Arnold ..... A61B 17/32053 30/363
4,845,844 A * 7/1989 Allen ..... B26B 27/00 30/1.5
4,852,769 A * 8/1989 Robertson ..... B67B 7/28 30/363
4,924,572 A * 5/1990 Vogel ..... B26B 13/12 30/253
4,987,683 A * 1/1991 Brych ..... G06K 21/06 30/363
5,007,171 A * 4/1991 Horning, Jr. ..... B65B 69/0033 30/DIG. 3
5,022,253 A * 6/1991 Parlatore ..... B21D 39/034 30/363
5,117,524 A * 6/1992 Chang ..... B43M 7/002 30/DIG. 3
5,347,671 A * 9/1994 Hunts ..... B65D 33/1675 30/DIG. 3
5,351,402 A * 10/1994 Mansfield ..... A47J 43/26 30/120.3
5,749,147 A * 5/1998 Hasegawa ..... B26B 13/06 30/134
5,752,319 A * 5/1998 Su ..... B67B 7/30 30/294
D419,417 S * 1/2000 Kane ..... D8/98
6,237,224 B1 * 5/2001 Park ..... B26B 17/00 30/29.5
6,263,761 B1 * 7/2001 Ryder ..... B67B 7/04 81/3.09
D453,458 S * 2/2002 Huang ..... D8/98
D458,820 S * 6/2002 Kay ..... D8/41
6,578,243 B1 * 6/2003 Hall ..... B67B 7/30 30/294
D477,765 S * 7/2003 Hall ..... D8/98
6,637,116 B1 * 10/2003 Hill ..... B26B 27/00 30/253
6,658,742 B2 * 12/2003 Votolato ..... B26B 27/00 30/DIG. 3
6,785,967 B1 * 9/2004 Allievi ..... A47G 21/065 30/120.1
6,786,117 B1 * 9/2004 Tseng ..... B25B 7/00 81/303
6,886,253 B2 * 5/2005 Chan ..... B67B 7/30 30/1.5
7,073,264 B2 * 7/2006 Votolato ..... B26B 27/00 30/294
7,121,425 B2 * 10/2006 Shanabrook ..... B44D 3/12 30/363
7,146,738 B2 * 12/2006 Yu ..... B26F 1/36 30/363
D544,320 S * 6/2007 Attaway ..... D8/14
D582,745 S * 12/2008 Neiser ..... D8/98
7,582,350 B2 * 9/2009 Kaposi ..... B67B 7/162 81/3.44
D604,131 S * 11/2009 Hasegawa ..... D8/40
7,730,620 B1 * 6/2010 Anastasi ..... B26B 3/08 30/294
D714,124 S * 9/2014 Fujino ..... D8/98
8,819,941 B2 * 9/2014 Mensch ..... A47J 43/26 30/120.4
8,869,406 B2 * 10/2014 Votolato ..... B26B 27/00 30/294
8,869,407 B2 * 10/2014 Votolato ..... B67B 7/30 30/294
8,869,408 B2 * 10/2014 Votolato ..... B26B 27/00 30/294
8,991,057 B2 * 3/2015 Jaynes ..... B67B 7/30 30/1.5
D738,694 S * 9/2015 Mensch ..... D7/680
D747,169 S * 1/2016 Koresh ..... D8/98
2002/0148118 A1 * 10/2002 Chang ..... B26D 3/16 30/253
2004/0211066 A1 * 10/2004 Horng ..... A47J 43/26 30/120.3
2005/0102838 A1 * 5/2005 Leason ..... B26B 5/00 30/134
2005/0198833 A1 * 9/2005 Lin ..... B23D 15/002 30/131
2007/0130775 A1 * 6/2007 Holbrook ..... A47J 43/26 30/120.4
2008/0141464 A1 * 6/2008 Pikielny ..... B25F 1/003 7/158
2008/0163491 A1 * 7/2008 Pearson ..... B26B 17/00 30/123
2011/0290080 A1 * 12/2011 McDuffee ..... A45D 29/02 81/3.09
2012/0285021 A1 * 11/2012 Park ..... B26B 27/00 30/29.5
2013/0097874 A1 * 4/2013 Jessen ..... A47J 43/26 30/120.2

(56) References Cited

U.S. PATENT DOCUMENTS

| | | | | |
|---|---|---|---|---|
| 2013/0333226 | A1* | 12/2013 | Greadington | B65B 61/02 30/165 |
| 2014/0109366 | A1* | 4/2014 | Dhubb | B25B 7/00 29/33.2 |
| 2015/0013170 | A1* | 1/2015 | Votolato | B67B 7/30 30/142 |
| 2015/0114188 | A1* | 4/2015 | Bullard | B21D 28/34 30/363 |
| 2015/0231014 | A1* | 8/2015 | Capobianco | B25F 1/00 7/158 |
| 2015/0266200 | A1* | 9/2015 | Dion | B26F 1/36 30/363 |
| 2016/0039651 | A1* | 2/2016 | Votolato | B67B 7/30 30/142 |

FOREIGN PATENT DOCUMENTS

| | | | | | |
|---|---|---|---|---|---|
| FR | 1013655 | A | * | 8/1952 | B26F 1/36 |
| FR | 1053907 | A | * | 2/1954 | B26F 1/36 |
| GB | 450194 | A | * | 7/1936 | B26F 1/36 |

* cited by examiner

OPENER DEVICE

CROSS-REFERENCES TO RELATED APPLICATIONS

Pursuant to the provisions of 37 C.F.R. § 1.53(c), this non-provisional application is a continuation-in-part of U.S. application Ser. No. 13/917,268, filed on Jun. 13, 2013, which claims the benefit of an earlier-filed provisional patent application, U.S. Application Ser. No. 61/656,624, filed on Jun. 13, 2012. All applications list the same inventors.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of devices made for opening bags. More specifically, the invention comprises a device having two arms which assist in opening bags.

2. Description of the Related Art

Plastic bags are used for many purposes. One common purpose is to transport and store foods, such as snacks in a sealed form. Bags can be filled with snacks, such as chips, candies, pretzels and peanuts, to name a few. The bags are often closed by heat sealing or treating with adhesive chemicals. These sealing mechanisms can create a seal that is very difficult to open without the assistance of a tool, such as scissors or a knife.

Several devices exist which are specifically designed for the purpose of opening a sealed bag. For example, there are several opening devices which use a sharp edge or razor within a plastic cover. This type of device allows a bag to slide over the razor, cutting a slice through the bag. However, there are no devices which effectively puncture and grasp a bag such that the user can easily tear open the bag. Additionally, there are no devices which use a dull edge permuting use on an airplane or by young children. Therefore, what is needed is a device which allows a snack bag to be punctured, grasped and torn open with ease without the need for an exposed edge.

The present invention achieves this objective, as well as others that are explained in the following description.

BRIEF SUMMARY OF THE INVENTION

The present invention comprises a bag opening device. The bag opening device has two arms, each having a first end and a second end. The first ends of each arm are connected together such that the arms can pivot together at the second ends of each arm. A gripping member is attached to the second end of the first arm and a slitting member is attached to the second end of the second arm. The gripping member has a surface, a raised portion and a channel. The slitting member has a surface, a crevice and a blade. The opener device can be used to open bags or other similar objects by placing the bag between the gripping member and the splitting member. As the two ends are pushed together the gripping surface of the gripping member pinches the bag into the crevice, such that the bag comes into contact with blade. The blade punctures the bag and the user can slide the device laterally across the top of the bag. The bag slides easily because it passes through an air gap in the device which is formed between surface of gripping member and surface of slitting member.

REFERENCE NUMERALS IN THE DRAWINGS

Figure 1:
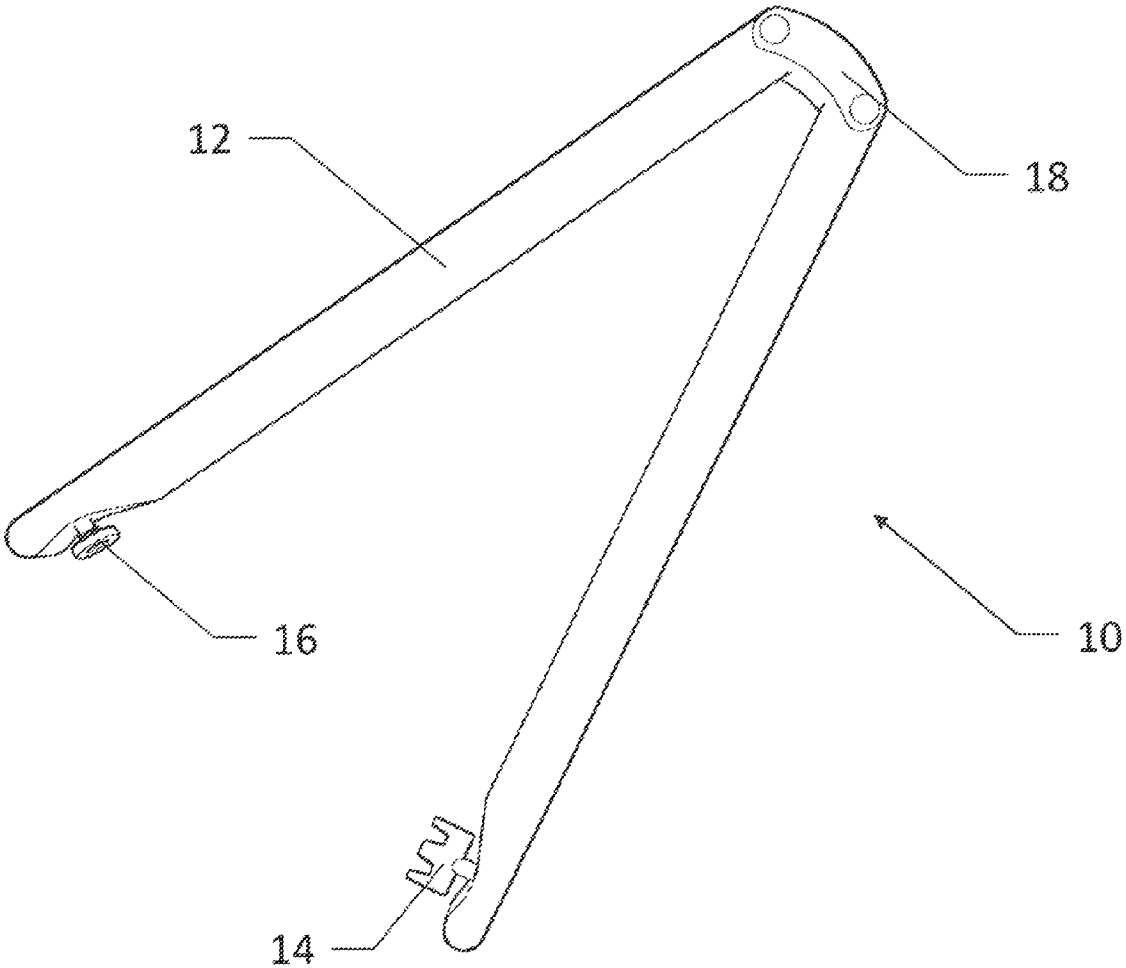
FIG. 1 is a perspective view, showing the present invention.

10 device
12 first arm
13 second arm
14 slitting member
16 gripping member
18 connecting piece
20 central void
22 gripping surface
24 central prong
26 outer prong
28 bag
30 user
32 alternate gripping member
34 alternate gripping surface
38 central void
40 alternate slitting member
42 openings
44 edges
100 device
120 first arm

140 second arm
160 slitting member
180 gripping member
200 stop
220 end cap
240 end cap
260 blade
280 surface
300 raised portion
320 channel
340 crevice
360 surface
380 bag
400 cap
420 connector
440 gripping surface
460 top opener
480 gap

DETAILED DESCRIPTION OF THE INVENTION

FIG. 1 illustrates the present invention. The device 10 has two arms 12, 13 that are connected together by any known means which allow first arm 12 and second arm 13 to pivot together and apart. For example, a bolt secured by a nut can be used as a pivoting means. First arm 12 and second arm 13 are designed so that the user can easily grip the device. The users hand can fit through opening 42 on each arm 12, 13 for use. Openings 42 on either arm 12, 13 assist the user in gripping and pivoting the arms into position to open a bag or a jar. FIG. 1 also illustrates a connecting piece 18 which connects a first end of first arm 12 and a first end of second arm 13 together. Connecting piece 18 can be any known device which attaches first arm 12 and second arm 13 such that the desired motion can be achieved. One example of a connecting piece 18 is a rivet which secures the first arm 12 and second arm 13.

At the second end of first arm 12 a gripping member 16 is attached. At the second end of second arm 13 a slitting member 14 is attached. Gripping member 16 and slitting member 14 meet when arms 12, 13 hinge together. As illustrated, the device can include a series of arced opening surfaces, or edges 44, for opening bottles or jars. The edges 44 are preferably serrated and located on the inside of each arm 12, 13. The bottle/jar opening surfaces, edges 44, would be arced in varying sizes which would allow the user to open bottles or jars of varying sizes. To open a bottle or jar edges 44 would be applied to the top (or lid) of a bottle or jar and the user would press the two arms 12, 13 together forming a tight partially closed circle around the top (or lid). In order to open the bottle or jar the user would turn the device and hold the bottle or jar in one place. This optional use could be added to give the present device additional functions.

Figure 2:
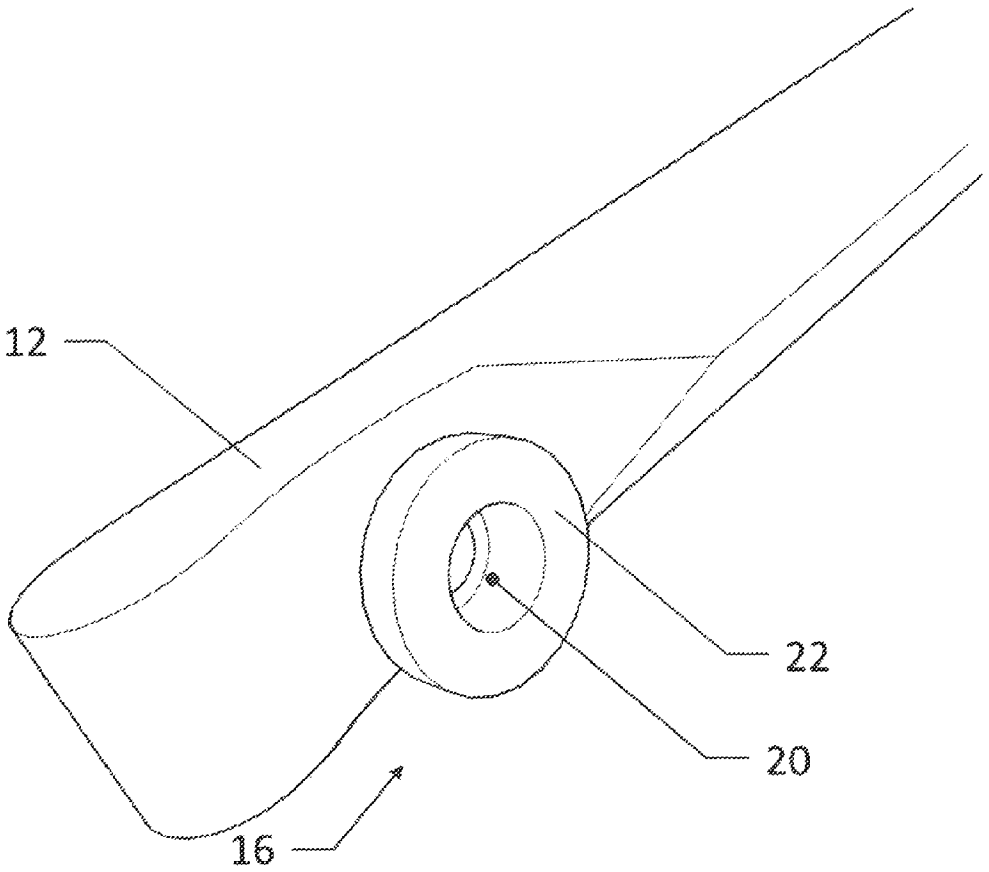
FIG. 2 is a perspective view, showing an expanded view of the gripping member of the present invention.

In FIG. 2, a close up view of the gripping member 16 is shown. Gripping member 16 is attached to the inside surface of first arm 12. Gripping member 16 can be attached by any method which fixes gripping member 16 in place on first arm 12. It is preferable that gripping member 16 has a central void 20. Gripping surface 22 is designed to contact bag (shown in FIG. 5) and hold the bag in place so that it can be punctured and torn.

Figure 3:
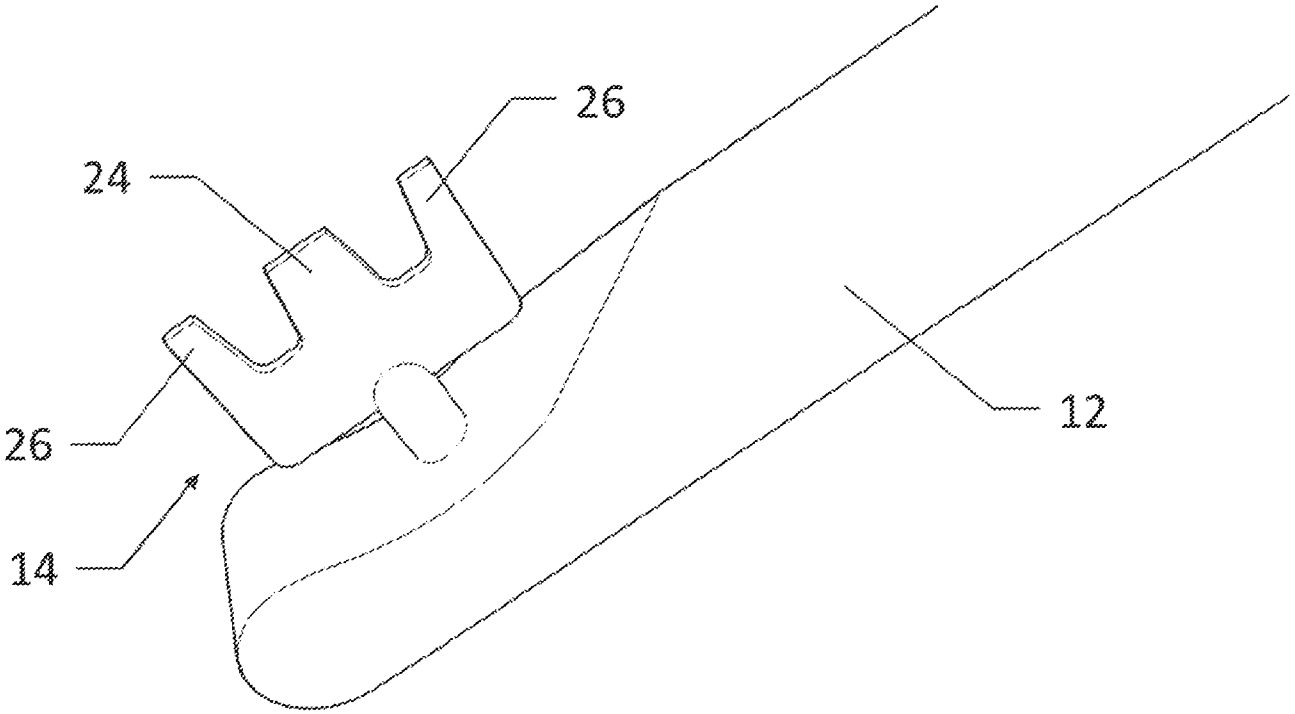
FIG. 3 is a perspective view, showing an expanded view of the slitting member of the present invention.
Figure 4:
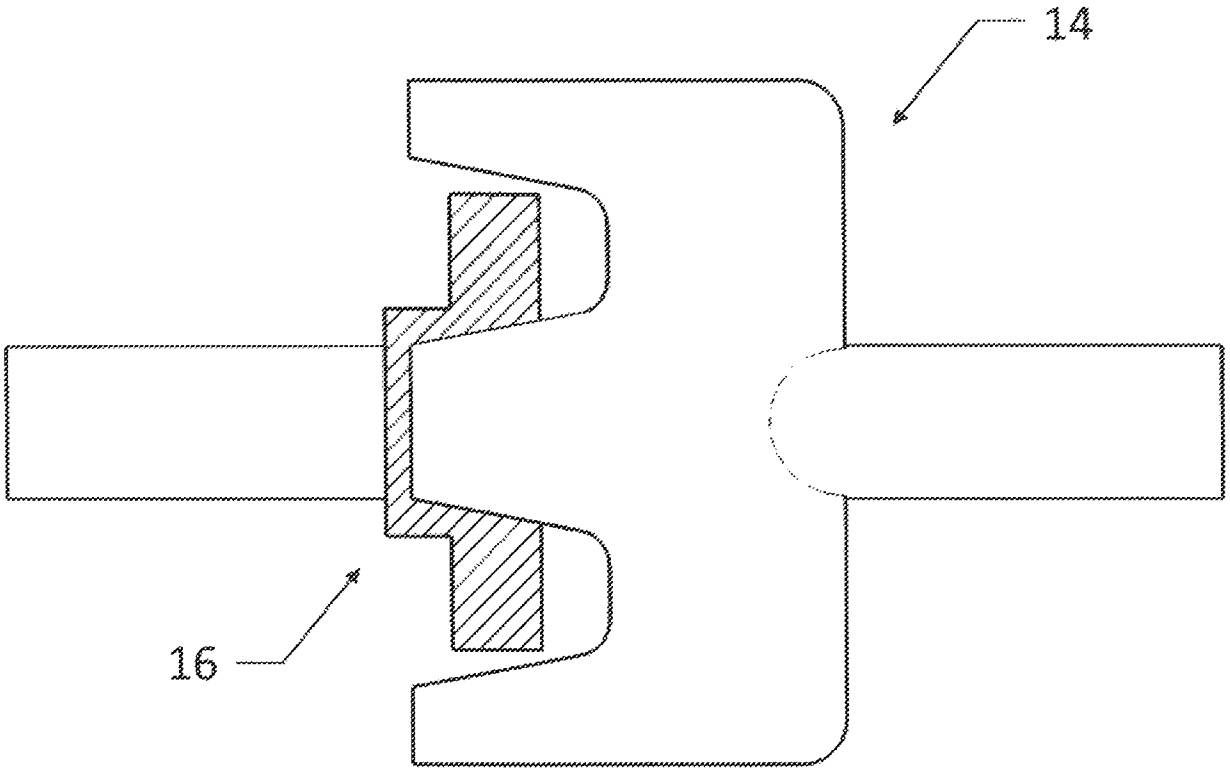
FIG. 4 is a cross section view, showing the gripping member and the slitting member of the present invention as they meet together.

As illustrated in FIG. 3, slitting member 14 is attached to the inside surface of second arm 13. Slitting member 14 preferably has three prongs, two outer prongs 26 and one central prong 24. Slitting member 14 is preferably made of a hard plastic sharpened or narrowed at the ends of the prongs. Although the prongs could be made to be very sharp, it is preferable that the ends of prongs 24, 26 are merely narrowed to a dull point which would not be capable of cutting a user's skin. Slitting member 14 can be any shape, having at least one prong, such that the snack bag is easily punctured. In order to easily puncture the snack bag, the slitter 14 is pushed through the bag opposite an open space (central void 20), while the snack bag is held flat against the surface of the pointed slitter member 14. The central void 20 on gripping member 16 allows even a dull surface to penetrate through the snack bag which is held taut against the gripping member 16. This is more clearly illustrated in a cross section view in FIG. 4, which shows the placement of the slitter 14 opposite of the gripping member 16 when arms 12, 13 are hinged together.

Figure 5:
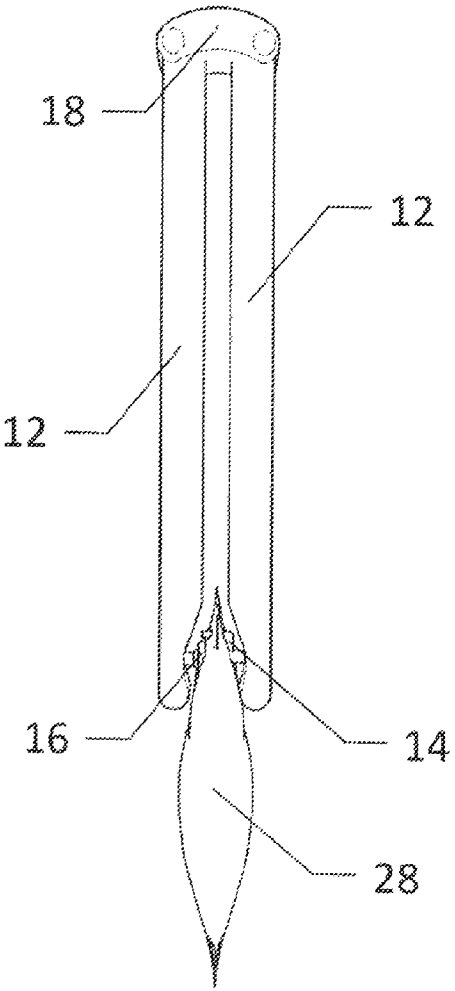
FIG. 5 is a perspective view, showing the present invention in use tearing through a snack bag.
Figure 6:
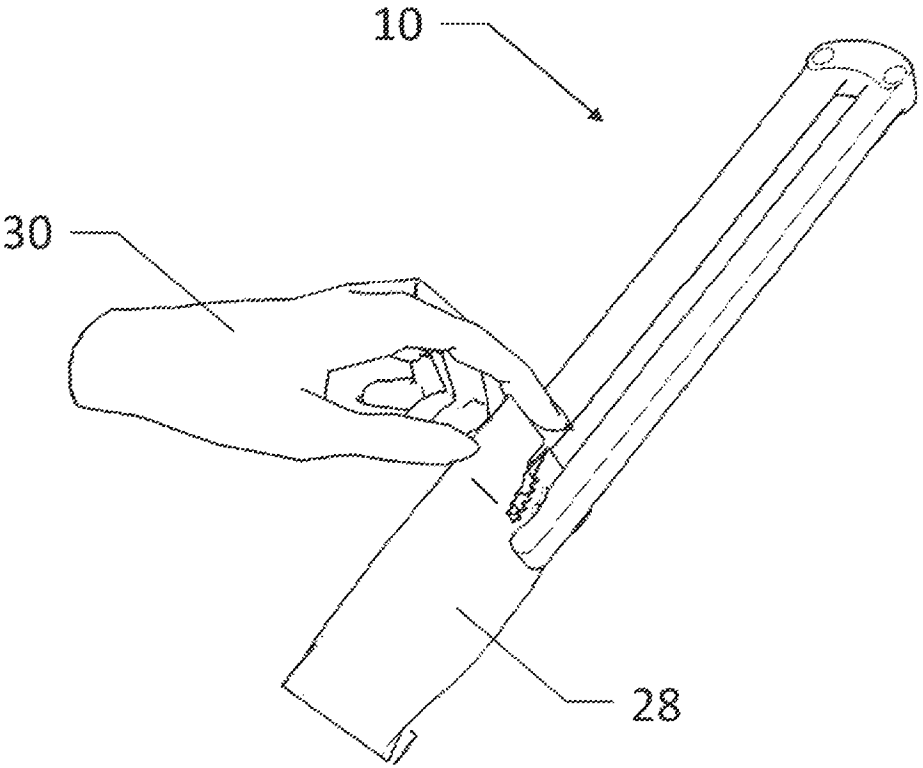
FIG. 6 is a perspective view, showing the present invention in use gripping and tearing a snack bag.

FIG. 5 shows the present invention in use. A snack bag 28 is placed between arms 12, 13 specifically between slitting member 14 and gripping member 16. The user presses arms 12, 13 toward one another (along a single plane). As the user presses arms 12, 13 together gripping member 16 grabs the bag 28 and holds it taut against gripping surface 22. As illustrated in FIG. 6, the user 30 can gently grasp bag 28 with one hand JO and device 10 with other hand (not shown) and slowly tear bag 28 in order to access the food or materials within. Gripping member 16 is capable of holding bag 28 in place, as the opening is widened by the user.

Figure 7:
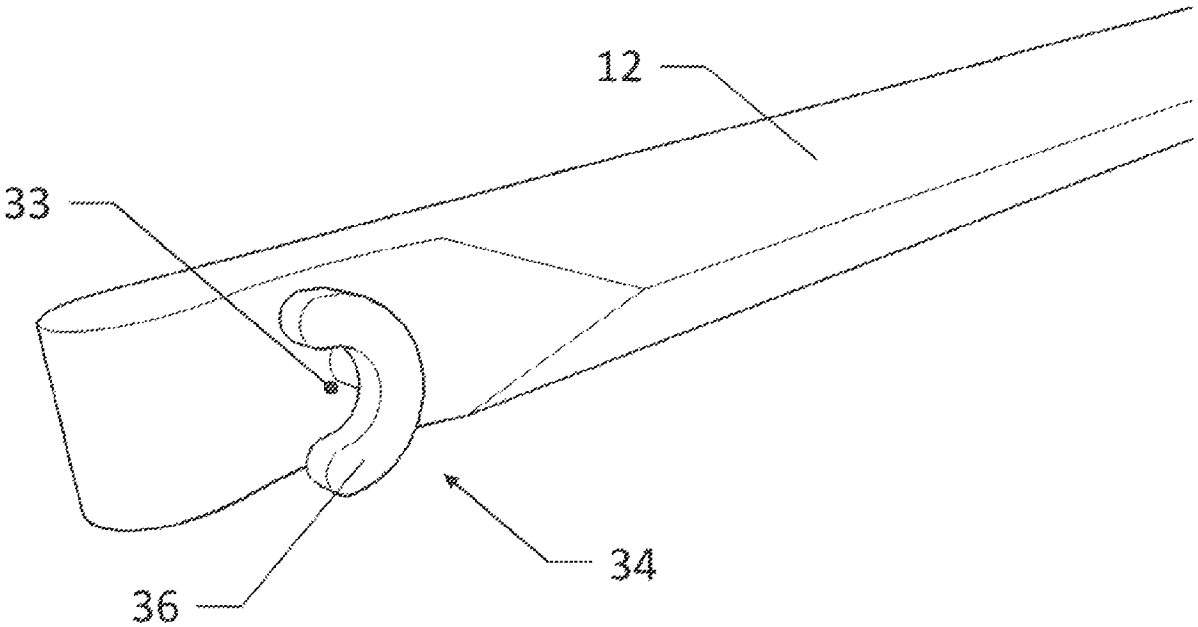
FIG. 7 is a perspective view, showing an alternate embodiment of the gripping member.
Figure 8:
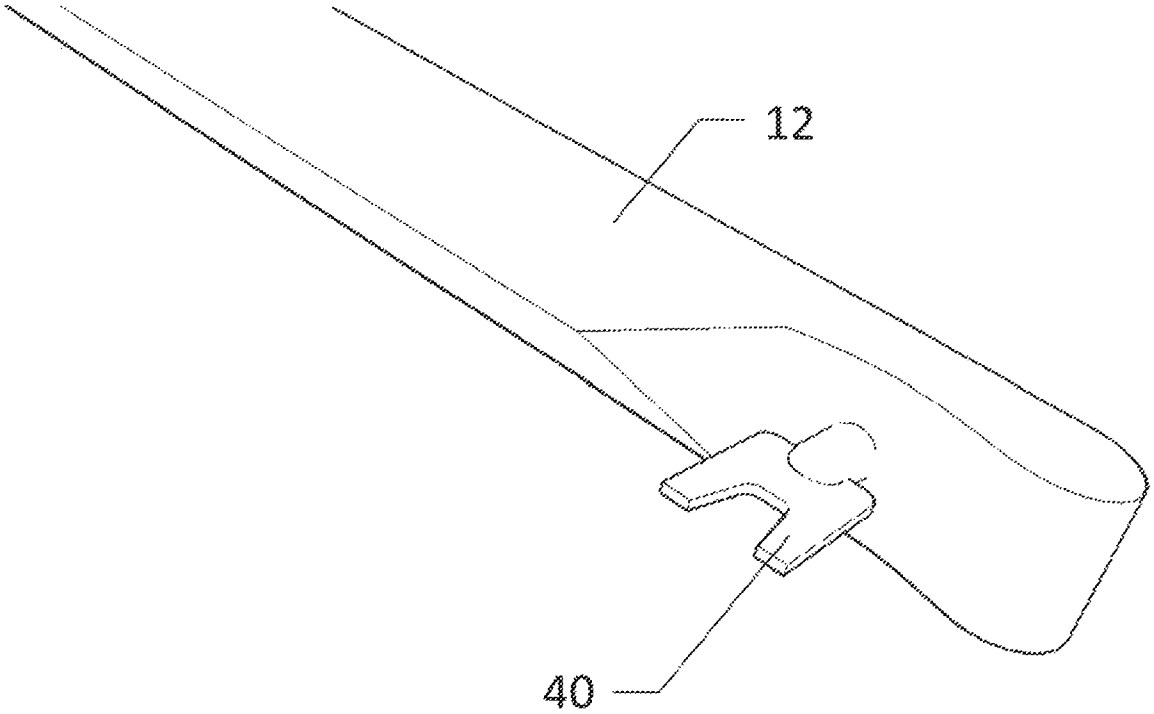
FIG. 8 is a perspective view, showing an alternate embodiment of the slitting member.

The illustration in FIG. 7 and FIG. 8 portrays an alternate embodiment of an alternate gripping member 34 and an alternate slitting member 40, respectively. In FIG. 7 alternate gripping member 34 is in a horseshoe shape which still allows for a central void 38. Gripping surface 36 is preferably textured such that the snack bag is held securely as the puncturing of the bag occurs. In FIG. 8 alternate slitting member 40 is shown with two prongs as opposed to three. Alternate slitting member 40 still has a sharpened or pointed surface in order to puncture the snack bag.

Figure 9:
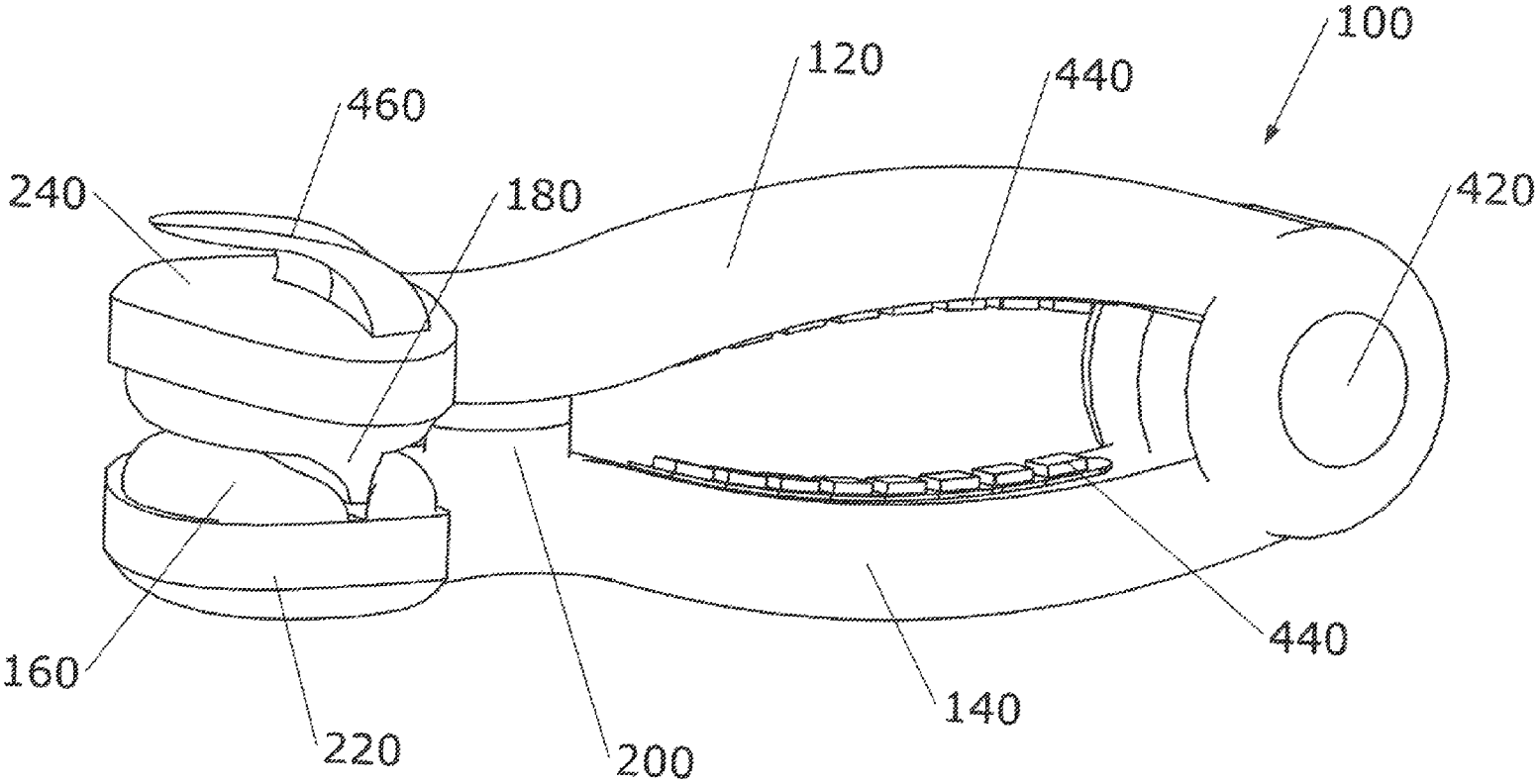
FIG. 9 is a perspective view, showing the present invention.

FIG. 9 illustrates the invention in the present embodiment. The device 100 has two arms 120, 140, each having a first end and a second end. The first end of first arm 120 and second arm 140 are connected together by any known means at connector 420 which allow first arm 120 and second arm 130 to pivot together and apart. For example, a bolt secured by a nut or a rivet which secures first arm 120 to second arm 140 can be used. However, any known method of creating a pivoting joint can be used. First arm 120 and second arm 140 have an interior surface and an exterior surface and are curved in design so that the user can easily grip the device. The user's hand can fit easily around the exterior surface of each arm 120, 140 for use.

The second end of first arm 120 and second arm 140 include end caps 240, 220. End cap 240 of first arm 120 includes a gripping member 180. End cap 220 of second arm 140 includes a slitting member 160. Gripping member 180 is capable of holding a snack bag or other object steady as slitting member punctures the object. Gripping member 180 and slitting member 160 meet when arms 120, 140 are pushed together. First arm 120 and second arm 140 include an optional stop 200 to allow gripping member 180 and slitting member 160 to meet together correctly.

Figure 16:
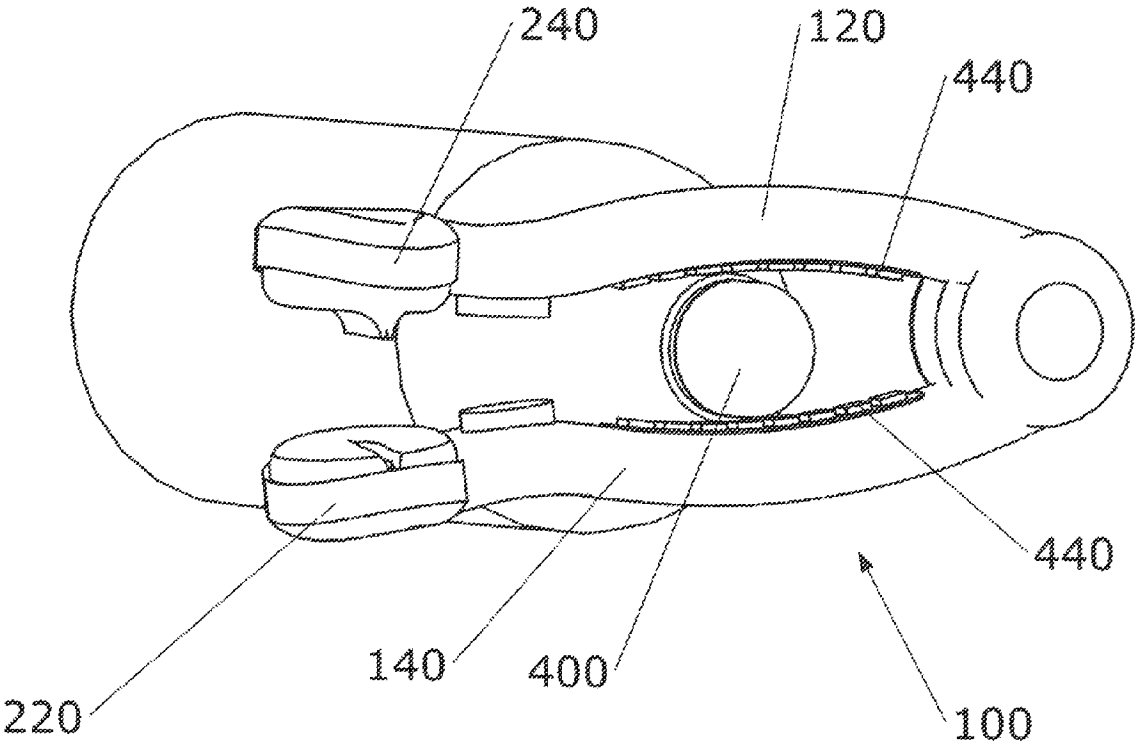
FIG. 16 is a perspective view, showing the present invention in use gripping and opening a bottle top using the gripping surface of the present invention.

As illustrated, the device can optionally include a gripping surface 440 on the interior surface of either arm 120, 140 for opening bottles or jars. The gripping surface 440 can be serrated and made of rubber to improve the grip on the cap of the bottle or jar. The slight arc of the arms allows the gripping surface 440 to have a slight curve to it in order to allow the user to open varying sizes of bottles or jars. To open a bottle or jar the user can press the two arms 120, 140 together forming a tight partially closed circle around cap 400 such that the gripping surface 440 is applied to cap 400 of a bottle or jar, as illustrated in FIG. 16. Device 100 is shown opening bottle cap 400. In order to open cap 400 the user turns the device and continues to press device 100 closed while holding the bottle or jar in one place.

An optional top opener 460 can also be included for opening a mechanism such as the stay-on-tab of a soda can. Top opener 460 is preferably integral with end cap 240 of first arm 120. As illustrated, top opener 460 is slightly wedge shaped such that as the user slides the top opener 460 under the stay-on-tab of a soda can the stay-on-tab is lifted upward away from the can.

Figure 10:
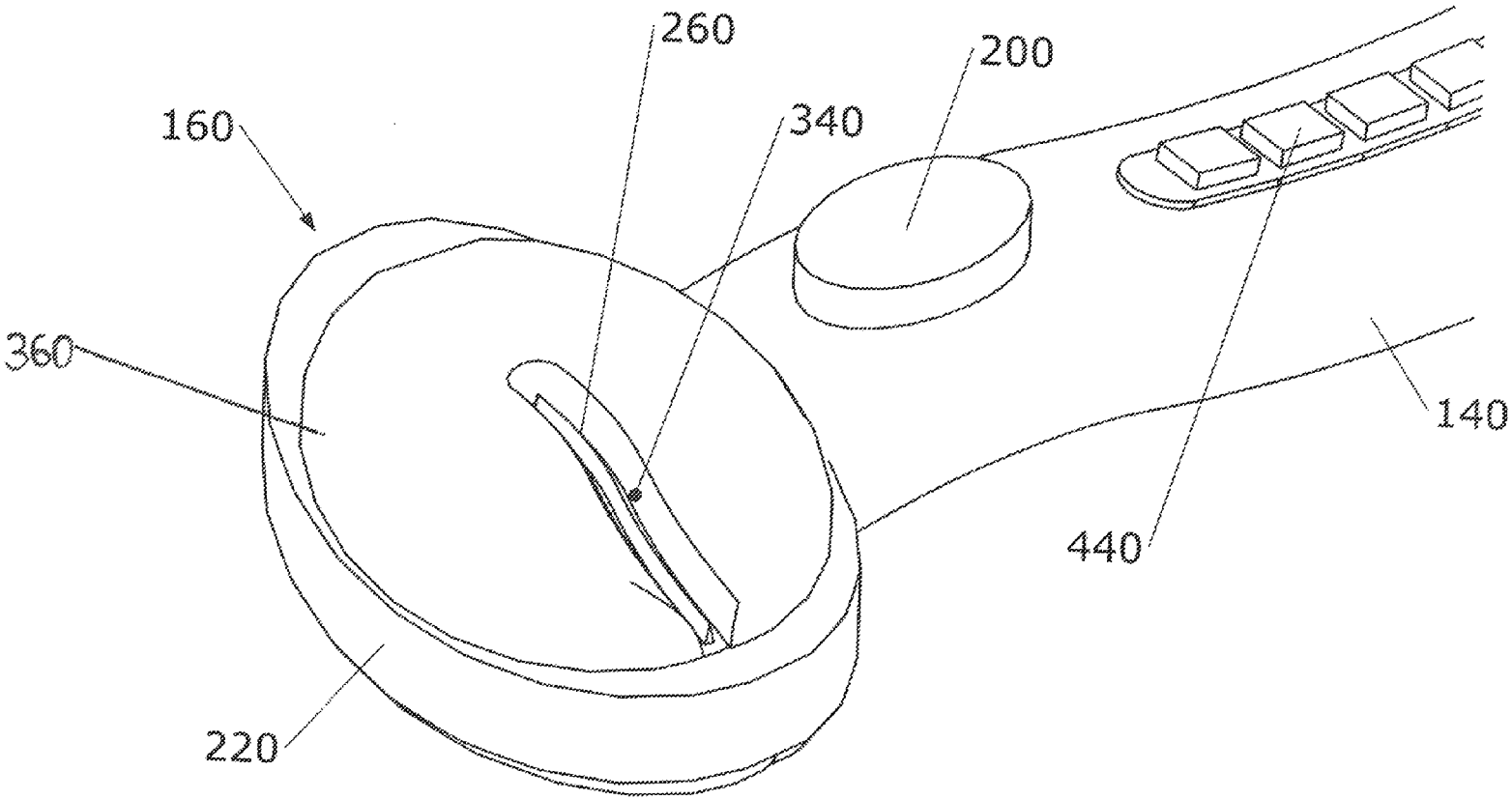
FIG. 10 is a perspective view, showing the slitting member of the present invention.
Figure 11:
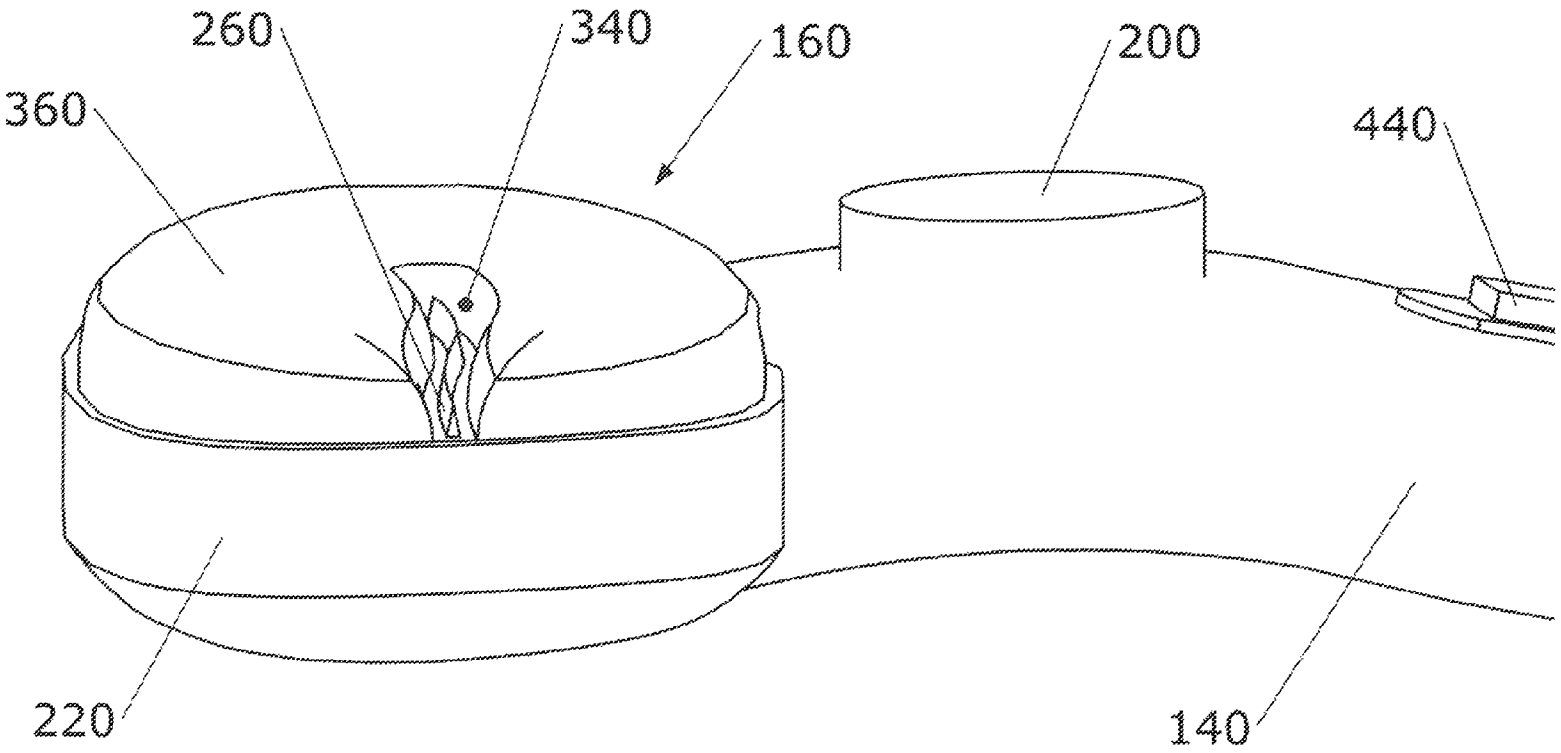
FIG. 11 is a perspective view, showing an expanded view of the slitting member of the present invention.

FIG. 10 illustrates the slitting member 160. Slitting member 160 is attached to end cap 220. Slitting member 160 includes blade 260, surface 360 and crevice 340. Surface 360 is curved and smooth along the slitting edge of blade 260. Slitter surface 360 forms crevice 340 which surrounds blade 260 such that a user can contact slitter surface 360 without contacting blade 260. A close up view is shown of slitting member 160 in FIG. 11. The reader will appreciate that the top edge of blade 260 is still within crevice 340. Blade 260 can be any shape. In one embodiments blade 260 is a flat, circular standard blade that is nested within end cap 220. Blade 260 extends into crevice 340 from beneath slitter surface 360. Slitter surface 360 curves about the contour of blade 260 such that blade 260 does not extend outward beyond slitter surface 360. Crevice 340 can be located along any area of the slitter surface 360 and can be in any shape. However, crevice 340 must be positioned to prevent blade 260 from being exposed.

Figure 12:
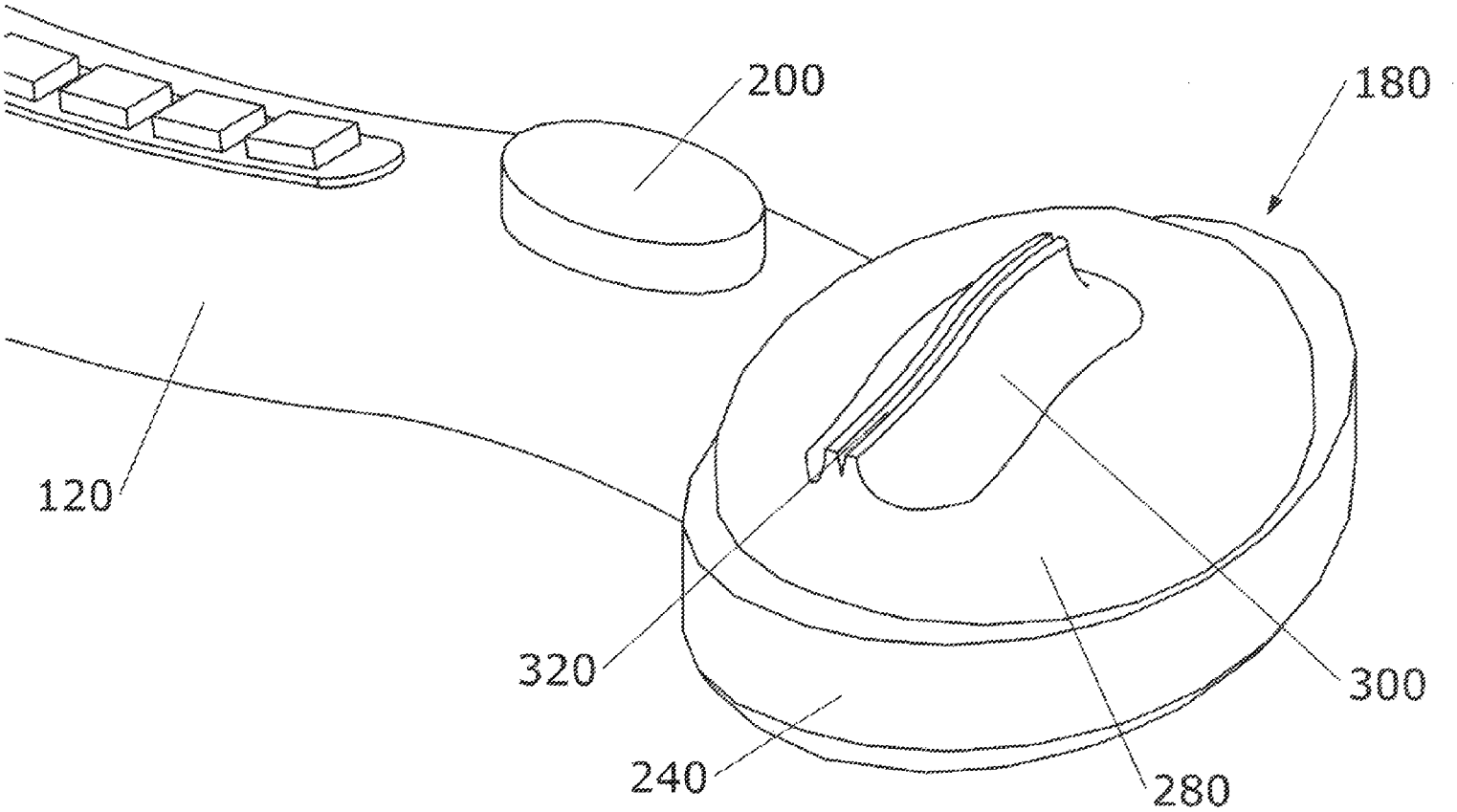
FIG. 12 is a perspective view, showing the gripping member of the present invention.
Figure 13:
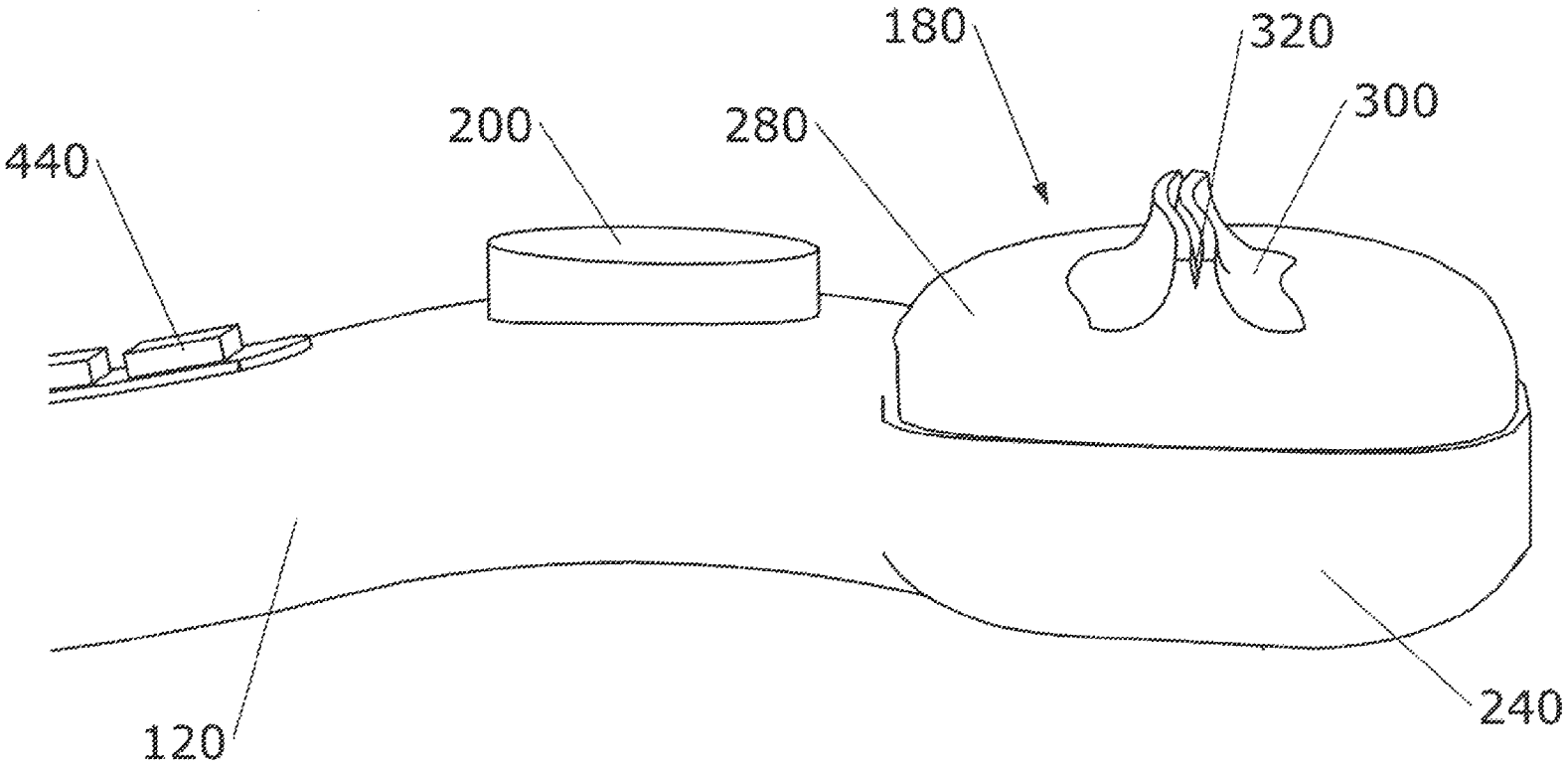
FIG. 13 is a perspective view, showing an expanded view of the gripping member of the present invention.
Figure 14:
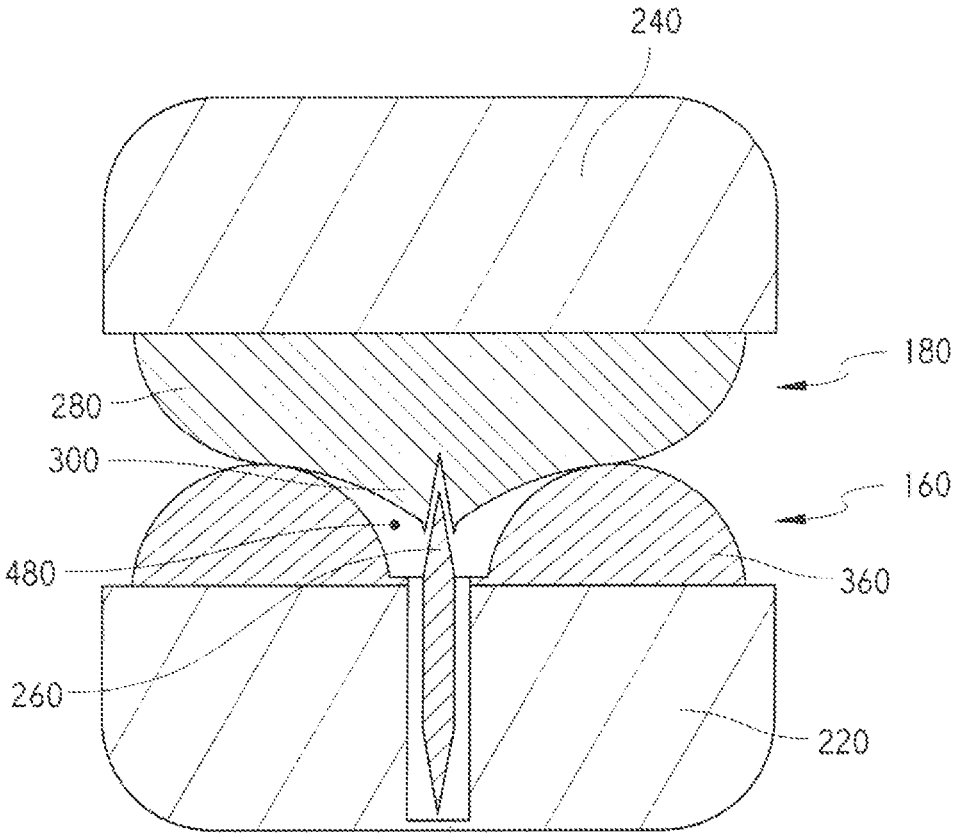
FIG. 14 is a cross section view, showing the gripping member and the slitting member of the present invention as they meet together.

A view of gripping member 180 is shown in FIG. 12. Gripping member 180 has a surface 280, a raised portion 300 and a channel 320. Surface 280 is preferably smooth and integral with raised portion 300. Raised portion 300 lifts away from surface 280 and includes channel 320. FIG. 13 shows a close up view of gripping member 180. Channel 320 is shown as curved for purpose of illustration, however channel 320 can be any shape or size. However, channel 320 must follow the contour of blade 260 included in slitting member 160. Therefore, when gripping member 180 and slitting member 160 meet together, as illustrated in a cross-section view in FIG. 14, blade 260 of slitting member 160 enters channel 320 of raised portion 300 but does not come into contact with raised portion 300. The contact between surface 280 and raised portion 300 of gripping member 180 and surface 360 of slitting member 160 allows for a continuous gap 480 formed within channel 320 and crevice 340, even when device 100 is fully closed (gap 480 is illustrated in FIG. 14). In the embodiment with a curved blade, surface 360 of slitting member 160 follows the continuous radial contour of the circular edge of blade 260 without ever coming into contact with blade 260.

Figure 15:
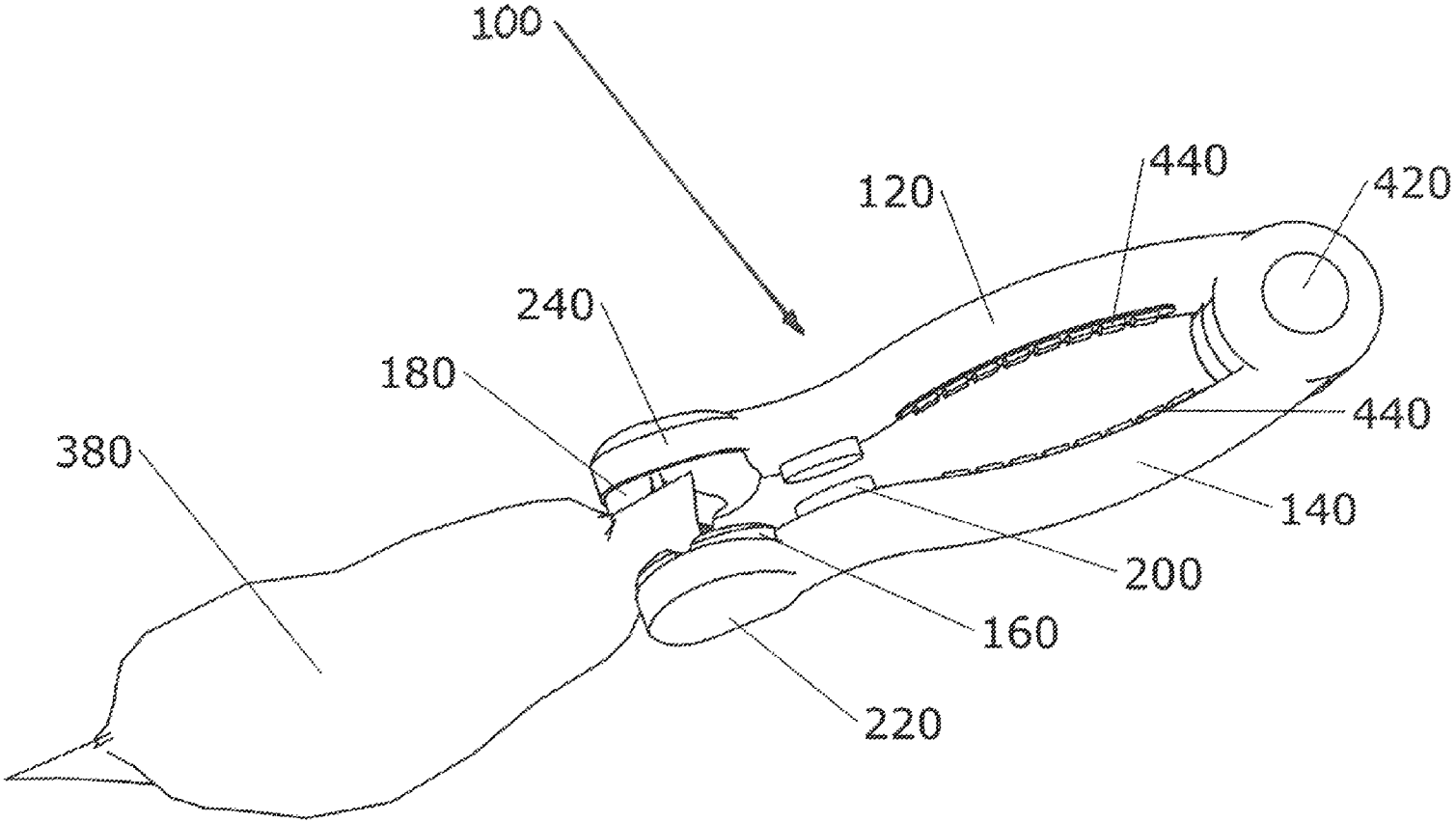
FIG. 15 is a perspective view, showing the present invention in use tearing through a snack bag.

The gap 480 allows the bag (or object) being cut to easily pass through along the bags length. Thus, the user can grip bag 380, as illustrated in FIG. 15, and pull device 100 along the length of bag 380. Bag 380 slides easily and smoothly through gap 480 created by device as slitting member 160 gently cuts the bag open. Gripping member 180 prevents bag 380 from escaping by pinching bag with the top of raised portion 300 into crevice 340 of slitting member 160. Again, an gap 480 is maintained such that bag 380 can slide easily through device 100 as blade 260 slices through the portion of bag 380 pushed into crevice 340 by raised portion 300 of gripping member 180.

The preceding description contains significant detail regarding the novel aspects of the present invention. It should not be construed, however, as limiting the scope of the invention but rather as providing illustrations of the preferred embodiments of the invention. As an example, the arms 120, 140 may not include gripping surface 440 and could be various different shapes. Thus, the scope of the invention should be fixed by the following claims, rather than by the examples given.

We claim:

1. An opener device for assisting a user with opening a bag, comprising:

a. a first arm, having a first end, a second end, an interior surface and an exterior surface;

b. a second arm, having a first end and a second end, an interior surface and an exterior surface, wherein said first end of said first arm and said first end of said second arm are pivotally connected;

c. a gripping member attached to said second end of said first arm, wherein said gripping member has a surface wherein said surface has a raised portion that defines a channel;

d. a slitting member attached to said second end of said second arm, wherein said slitting member has a surface, wherein a crevice is defined by said slitting member surface and houses a blade having a length and a height, wherein said crevice extends around said length and said height of said blade;

e. wherein said surface of said gripping member and said surface of said slitting member meet together when said first arm and said second arm are pivoted together such that said raised portion of said gripping member enters said crevice of said slitting member thereby allowing said blade to cooperate with said channel to pierce said bag.

2. The opener device as recited in claim 1, wherein said gripping member further comprises an end cap of said first arm; and wherein said slitting member further comprises an end cap of said second arm.

3. The opener device as recited in claim 1, further comprising a top opener attached to said end cap of said gripping member.

4. The opener device as recited in claim 1, wherein said first arm and said second arm further comprise a gripping surface attached to said interior surfaces of said first arm and said second arm.

5. The opener device as recited in claim 1, wherein said first arm and said second arm are curved.

6. The opener device as recited in claim 1, wherein said first arm has a stop proximate said second end of said first arm and said second arm has a stop proximate said second end of said second arm.

7. The opener device as recited in claim 1, wherein said surface of said slitting member is smooth and extends above said blade.

8. The opener device as recited in claim 7, wherein said blade enters said channel of said gripping member when said first arm and said second arm are pivoted together.

9. The opener device as recited in claim 1, wherein when said slitting member surface meets together with said gripping member surface and said raised portion is in said crevice, said slitting member surface, said crevice, said blade, said raise portion, and said channel all define a gap.

10. An opener device for assisting a user with opening a bag having an open position and a closed position, comprising:

a. a first arm, having a first end and a second end;

b. a second arm, having a first end and a second end;

c. wherein said first end of said first arm and said first end of said second arm are pivotably connected by a connector configured to allow said second end of said first arm and said second end of said second end to pivot together to said closed position and pivot away from one another to said open position;

d. a gripping member attached to said second end of said first arm, wherein said gripping member has an end cap and a surface, wherein said surface of said gripping member has a raised portion that defines a channel;

e. a slitting member attached to said second end of said second arm, wherein said slitting member has an end cap and a surface, wherein a crevice is defined by said surface of said slitting member and fully houses a blade having a length and a height; and f. wherein when said device is in said closed position said raised portion of said gripping member enters said crevice and contacts said surface of said slitting member and wherein said blade of said slitting member enters said channel of said gripping member such that said blade is capable of puncturing said bag.

11. The opener device as recited in claim 10, further comprising a top opener attached to said end cap of said first arm.

12. The opener device as recited in claim 11, wherein said first arm and said second arm further comprise a gripping surface attached to an interior surface of said first arm and said second arm.

13. The opener device as recited in claim 10, wherein said first arm and said second arm are curved.

14. The opener device as recited in claim 10, wherein said first arm has a stop proximate said second end of said first arm and said second arm has a stop proximate said second end of said second arm.

15. The opener device as recited in claim 10, wherein said surface of said slitting member is smooth and extends above said blade to prevent said blade from being exposed to said user.

16. The opener device as recited in claim 10, wherein when in the closed position, said slitting member surface, said crevice, said blade, said raise portion surface, and said channel all define a gap.

17. An opener device for opening a bag, comprising a. a first arm and a second arm pivotably connected together at a connector;

b. wherein said first arm further comprises an end cap attached to a gripping member, wherein said gripping member has a surface, wherein said surface has a raised portion that defines a channel;

c. wherein said second arm further comprises an end cap attached to a slitting member having a second surface, wherein a crevice is defined by said second surface and fully houses a blade; and d. wherein said first arm and said second arm are capable of pivoting together such that said blade housed within said crevice of said slitting member enters said channel of said gripping member and said raised portion of said gripping member enters said crevice.

18. The opener device as recited in claim 17, further comprising a top opener attached to said end cap of said first arm.

* * * * *